US008213662B2

(12) United States Patent
Ishida

(10) Patent No.: US 8,213,662 B2
(45) Date of Patent: Jul. 3, 2012

(54) EARPAD AND HEADPHONES

(75) Inventor: Hiroyuki Ishida, Tokyo (JP)

(73) Assignee: Sony Corporation, Tokyo (JP)

( * ) Notice: Subject to any disclaimer, the term of this patent is extended or adjusted under 35 U.S.C. 154(b) by 954 days.

(21) Appl. No.: 12/234,791

(22) Filed: Sep. 22, 2008

(65) Prior Publication Data

US 2009/0110226 A1 Apr. 30, 2009

(30) Foreign Application Priority Data

Oct. 25, 2007 (JP) ..... P2007-277971

(51) Int. Cl.
*H04R 25/00* (2006.01)

(52) U.S. Cl. ..... 381/371; 381/345; 381/370

(58) Field of Classification Search ..... None
See application file for complete search history.

(56) References Cited

U.S. PATENT DOCUMENTS

| | | | | |
|---|---|---|---|---|
| 4,856,118 | A | 8/1989 | Sapiejewski | |
| 4,965,836 | A * | 10/1990 | Andre et al. | 381/370 |
| 5,001,763 | A * | 3/1991 | Moseley | 381/71.6 |
| 5,109,424 | A * | 4/1992 | Andre et al. | 381/384 |
| 5,708,725 | A * | 1/1998 | Ito | 381/370 |
| 7,853,034 | B1 * | 12/2010 | Gresko | 381/372 |
| 7,885,419 | B2 * | 2/2011 | Wahl et al. | 381/74 |
| 7,907,394 | B2 * | 3/2011 | Richardson et al. | 361/679.3 |
| 2003/0103637 | A1 * | 6/2003 | Huang | 381/309 |
| 2007/0183616 | A1 * | 8/2007 | Wahl et al. | 381/370 |
| 2007/0184881 | A1 * | 8/2007 | Wahl et al. | 455/575.2 |
| 2007/0223766 | A1 * | 9/2007 | Davis et al. | 381/379 |
| 2009/0028356 | A1 * | 1/2009 | Ambrose et al. | 381/71.6 |
| 2009/0110226 | A1 * | 4/2009 | Ishida | 381/370 |
| 2010/0183173 | A1 * | 7/2010 | Teske-Fischer et al. | 381/151 |
| 2010/0320961 | A1 * | 12/2010 | Castillo et al. | 320/107 |
| 2011/0002475 | A1 * | 1/2011 | Kimura | 381/71.6 |

FOREIGN PATENT DOCUMENTS

| | | | |
|---|---|---|---|
| EP | 1 075 164 | A2 | 2/2001 |
| EP | 2053874 | A1 * | 4/2009 |
| GB | 2 394 166 | A | 4/2004 |
| JP | 3045051 | | 3/2000 |

OTHER PUBLICATIONS

European Search Report from European Patent Office dated Jan. 30, 2009, for Application No. 08253056.9-2225, 3 pages.

* cited by examiner

*Primary Examiner* — Marlon Fletcher
(74) *Attorney, Agent, or Firm* — Finnegan, Henderson, Farabow, Garrett & Dunner, L.L.P.

(57) ABSTRACT

There is provided an earpad that is attachable to a housing capable of containing an audio signal processing unit and includes a ring-shaped cushioning member and a covering member covering the ring-shaped cushioning member. In the earpad, the ring-shaped cushioning member includes an outer ring member, a middle ring member and an inner ring member, and the hardness of the middle ring member is different from the hardness of the outer ring member and the inner ring member.

7 Claims, 12 Drawing Sheets

EARPAD AND HEADPHONES

CROSS REFERENCES TO RELATED APPLICATIONS

The present invention contains subject matter related to Japanese Patent Application JP 2007-277971 filed in the Japan Patent Office on Oct. 25, 2007, the entire contents of which being incorporated herein by reference.

BACKGROUND OF THE INVENTION

1. Field of the Invention

The present invention relates to an earpad and headphones.

2. Description of the Related Art

Headphones are used for a user wearing them to listen to sounds. Headphones have two (left and right) housings each containing a loudspeaker. On one surface of each housing to be placed opposite to the user's head, an earpad is placed as cushioning that prevents the housing from coming into direct contact with the user's head.

In addition to serving as cushioning, the earpad serves to enclose a space between the housing and the user's ear so as to improve the quality of a sound and prevent a sound from leaking out. There are two types of headphones: enclosed headphones and open headphones, and the tightness of an enclosed space by the earpad is particularly important for enclosed headphones. The enclosure tightness by the earpad is enhanced by an increase in a contact area with the user's head resulting from the deformation of the earpad yielding to the shape of the user's head wearing headphones. A conventional approach to enlarge a contact area with the user's head is to increase the entire size of the earpad.

SUMMARY OF THE INVENTION

However, portability is important for headphones in which the earpad is used, and the large earpad reduces portability.

In light of the foregoing, it is desired to provide novel and improved earpad and headphones capable of enhancing the enclosure tightness and maintaining portability.

According to an embodiment of the present invention, there is provided an earpad that includes a ring-shaped cushioning member and a covering member covering the ring-shaped cushioning member, wherein the ring-shaped cushioning member includes an outer ring member, a middle ring member and an inner ring member, the hardness of the middle ring member is different from the hardness of the outer ring member and the inner ring member, and the earpad is attachable to a housing capable of containing an audio signal processing unit. The hardness of the middle ring member may be lower than the hardness of the outer ring member. Further, the hardness of the middle ring member may be lower than the hardness of the inner ring member.

In this structure, the hardness of the middle ring member is lower than the hardness of the inner ring member and the outer ring member. Therefore, when the ring-shaped cushioning member is covered with the covering member, the outer ring member and the inner ring member are deformed toward the middle ring member due to the tensile force of the covering member. Consequently, the tensile force of the covering member is absorbed by the deformation, so that the upper surfaces of the outer ring member and the inner ring member (the surfaces to come into contact with the user's head) become substantially flat. Because the user's head comes into contact with such a flat surface, a contact area between the user's head and the earpad is enlarged, thereby enhancing the enclosure tightness by the earpad.

The hardness of the inner ring member may be lower than the hardness of the outer ring member. In this structure, because hardness of the inner ring member is lower than the hardness of the outer ring member, the tensile force of the covering member is absorbed mostly by the deformation of the inner ring member. This reduces the amount of deformation of the outer ring member. The part of the user's head around the ear becomes farther from the housing to which the earpad is attached with distance from the ear. In the above structure, the outer ring member projects toward the head more largely than the inner ring member so as to fit the shape of the head around the ear, thereby enhancing the enclosure tightness.

The middle ring member may have a hole. In this structure, by making a hole in the middle ring member, the hardness of the middle ring member is lower than the hardness of the outer ring member and the inner ring member. If the ring-shaped cushioning member is made of a porous medium such as urethane foam, for example, the hole is made in addition to those holes of the medium. The hole may be a through-hole or a non-through-hole. The hole may be made in the direction from the user's head toward the housing. Thus, the hole may be made in the direction substantially perpendicular to the plane of the ring-shaped cushioning member. The cross-sectional shape of the hole may be substantially circular, oval, elliptical, rectangular, polygonal and so on.

The middle ring member may be configured as a bridge member joining the outer ring member and the inner ring member. In this structure, by joining the outer ring member and the inner ring member through the bridge member, the hardness of the middle ring member may be adjusted by the material, placement, size or the like of the bridge member. By changing the material, size or the like of the bridge member, the hardness of the middle ring member can be adjusted, just like by making the hole as described above.

The hardness of the middle ring member may be lower in a rear part than in a front part. In this structure, because the hardness of the middle ring member in the rear part is lower, the rear part is more likely to yield to the shape of the user's head compared with the front part.

According to another embodiment of the present invention, there is provided headphones that include a housing capable of containing an audio signal processing unit, and an earpad attached to the housing and including a ring-shaped cushioning member and a covering member covering the ring-shaped cushioning member. The ring-shaped cushioning member of the earpad includes an outer ring member, a middle ring member and an inner ring member, and the hardness of the middle ring member is different from the hardness of the outer ring member and the inner ring member. In this structure, a contact area between the user's head and the earpad is enlarged, thereby enhancing the enclosure tightness by the earpad.

According to the embodiments of the present invention described above, it is possible to enhance the enclosure tightness and maintain portability

DETAILED DESCRIPTION OF THE PREFERRED EMBODIMENTS

Figure 1:
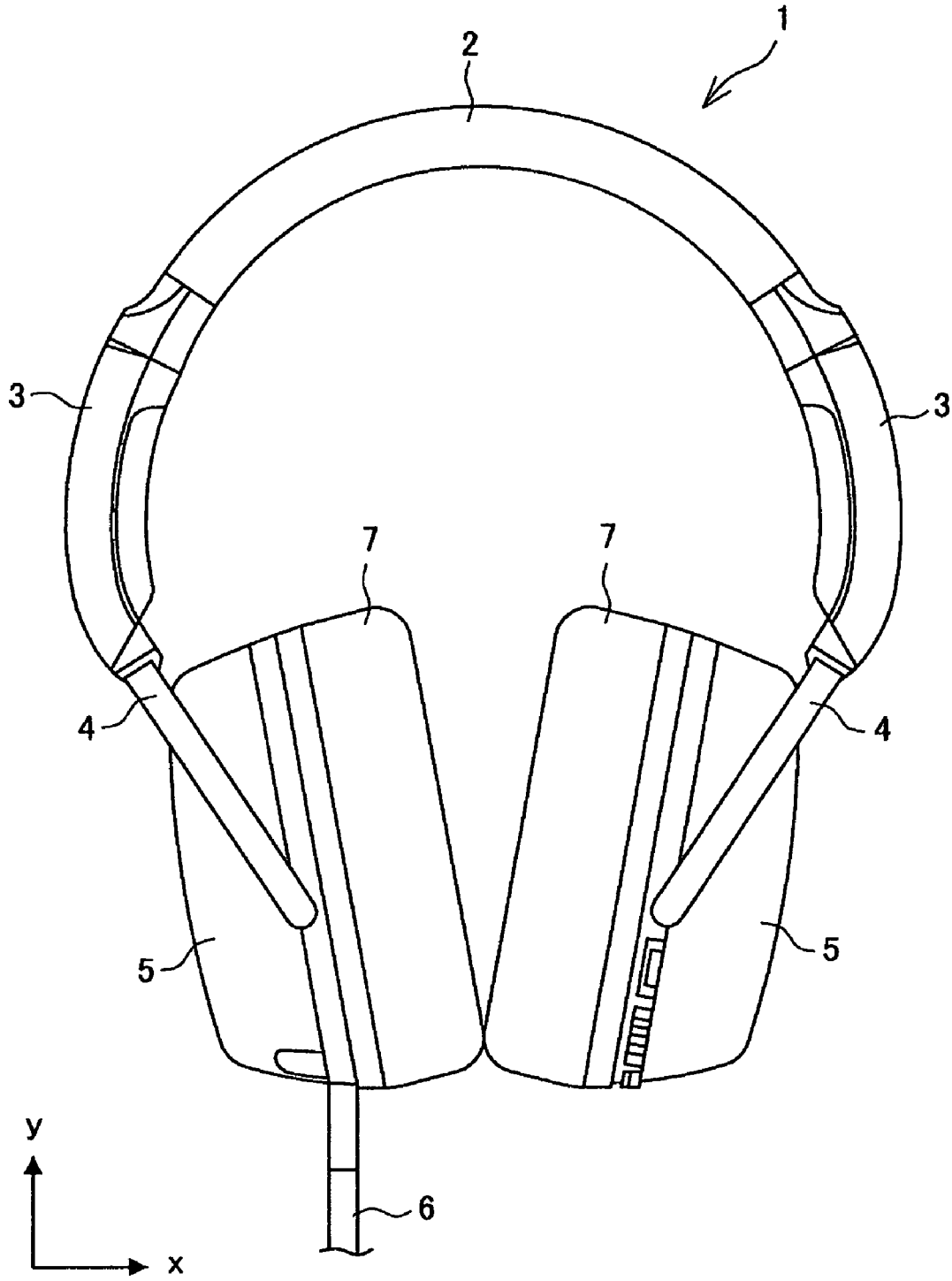
FIG. 1 is an explanatory illustration showing headphones to which an earpad according to embodiments of the present invention is attached.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

<Headphones>

The outline of headphones to which an earpad according to embodiments of the present invention is attached is described hereinafter with reference to FIGS. 1 and 2. Subsequently, the earpad according to embodiments of the present invention is described in detail.

Figure 2:
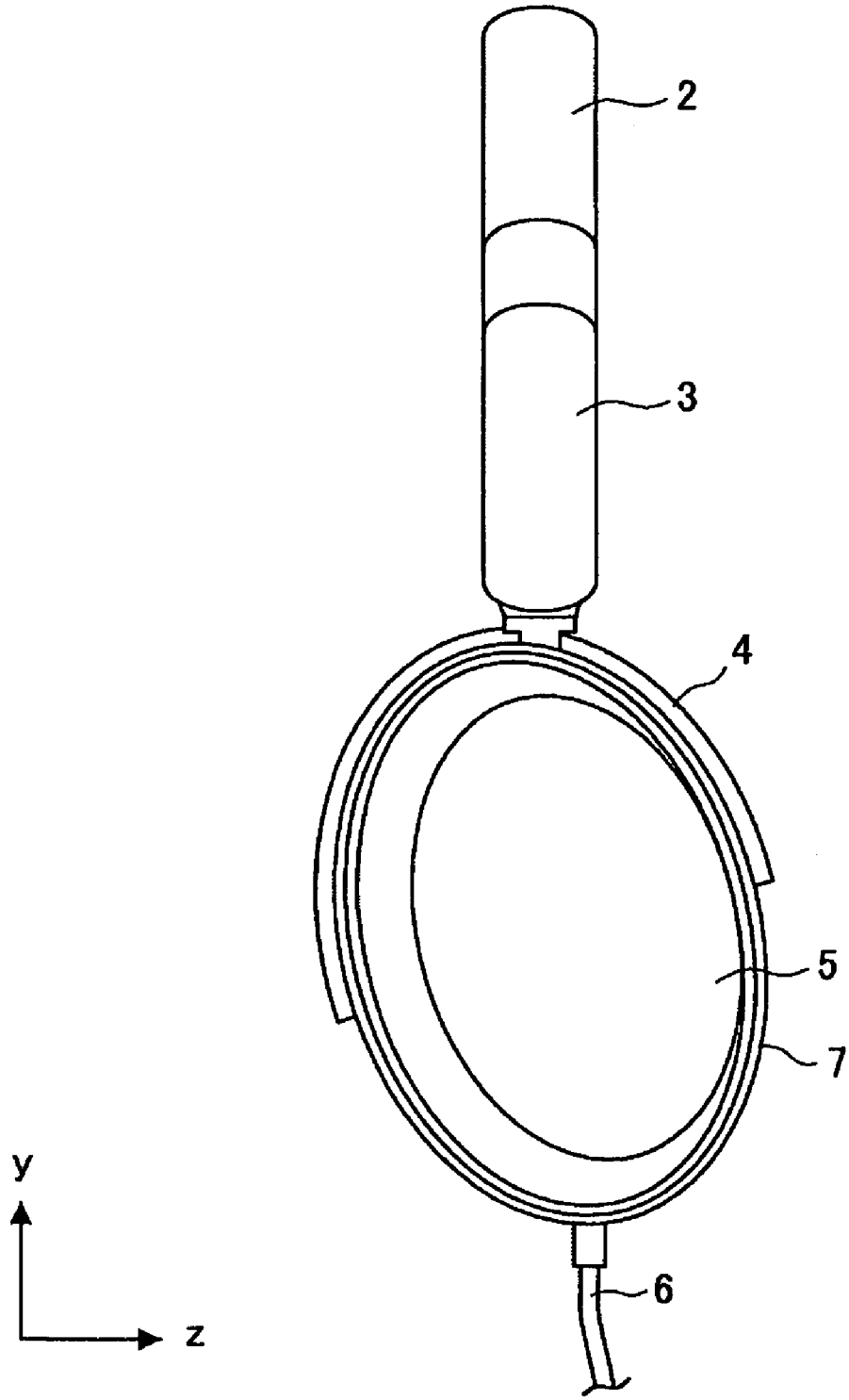
FIG. 2 is an explanatory illustration showing headphones to which an earpad according to embodiments of the present invention is attached.

FIGS. 1 and 2 are explanatory illustrations showing the headphones to which the earpad according to embodiments of the present invention is attached. Referring to FIG. 1, headphones 1 include a headband 2, left and right sliders 3, hangers 4, housings 5, earpads 7 and a cord 6.

In FIG. 1, the positive direction of the x-axis is the right direction for a user, and the positive direction of the y-axis is the upward direction for a user. In FIG. 2, the negative direction of the z-axis is the front direction for a user. Accordingly, the slider 3, the hanger 4, the housing and the earpad 7 in the positive direction of the x-axis are for the right ear of a user, and the slider 3, the hanger 4, the housing 5 and the earpad 7 in the negative direction of the x-axis are for the left ear of a user.

The headband 2 is a connection member that connects the left and right sliders 3. When a user wears the headphones 1, at least part of the headband 2 usually comes into contact with the top of the user's head to thereby support the headphones 1. The headband 2 has predetermined rigidity and elasticity, and the curved shape of the headband 2 is stretched to enlarge a space between the both earpads 7, so that the headphones 1 can be held on the user's head.

The sliders 3 are sliding members that couple the headband 2 and the hangers 4 and support the hangers 4 axially slidably with respect to the headband 2. Specifically, the sliders 3 can be extended and contracted, and as a result of extension and contraction of the sliders 3, each member below the hangers 4 moves downward with respect to the headband 2. Thus, when wearing the headphones 1, extension and contraction of the sliders 3 are adjusted in accordance with the user's head size, the distance from the ears to the top of the head and so on, so that the housings 5 are positioned opposite to the user's ears. On the other hand, when not in use, the headphones 1 can be stored with the sliders 3 being contracted, which saves a storage space.

The hangers 4 are rotating members that couple the sliders 3 and the earcups 5 and support the housings 5 rotatably about a rotation axis substantially in the cross direction (the z-axis). Further, the hangers 4 are supported by the sliders 3 rotatably about a rotation axis substantially in the longitudinal direction (the y-axis). Accordingly, the hangers 4 rotate about the y-axis and also make the housings 5 rotate about the z-axis. Thus, at the time of wearing the headphones 1, the orientation of the housings 5 can be changed in accordance with the shape around the user's ears, so that the housings 5 are positioned opposite to the ears.

Housings 5 are housing units that contain a small loudspeaker (not shown). In the housings 5, a given electrical circuit (which is also referred to as an acoustic circuit; an example of an audio signal processing unit) or the like that performs signal processing such as sound localization, noise canceling and signal amplification on an audio signal for driving the loudspeaker may be placed. Further, the cord 6 for input signals, one end of which is connected to an input terminal (not shown), is connected to the right or left housing 5, and the other end of the cord 6 is connected to the speaker or the acoustic circuit that are contained in the housing 5. In order to drive the loudspeaker in the housing 5 to which the cord 6 is not connected, a connection cord (not shown) is placed between the housing 5 to which the cord 6 is connected and the housing 5 to which the cord 6 is not connected. The connection cord is placed inside the hangers 4, the sliders 3 and the headband 2. In other words, an audio signal that is input to one housing 5 through the cord 6 is further input to the other housing 5 through the connection cord, thereby driving the both left and right loudspeakers. As a result of driving the loudspeakers, the audio signal is converted into a sound and supplied to the user's ears.

The earpads 7 are attached to the surfaces of the housings 5 that are opposite to user's ears as cushioning between the housings 5 and a user's head. Because direct contact of the housings 5 that are made of a non-deformative rigid material with a user's head causes significant decrease in the comfort of a user wearing them, the elastic earpads 7 are placed to avoid direct contact of the housings 5 with a user as cushioning between them. Further, the earpads 7 of the headphones 1 according to embodiments of the present invention enclose a space between the user's head and the loudspeaker inside the housing 5, thereby improving the quality of a sound which a user hears and preventing the sound from leaking out. The earpads 7 can be detached from the housings 5 and they are thus replaceable. The housings 5 and the earpads 7 in combination are also referred to as earcups.

The earpad 7 according to embodiments of the present invention can further enhance the enclosure tightness, which is different from other earpads. The earpad 7 is described in detail hereinbelow.

First Embodiment

Figure 3A:
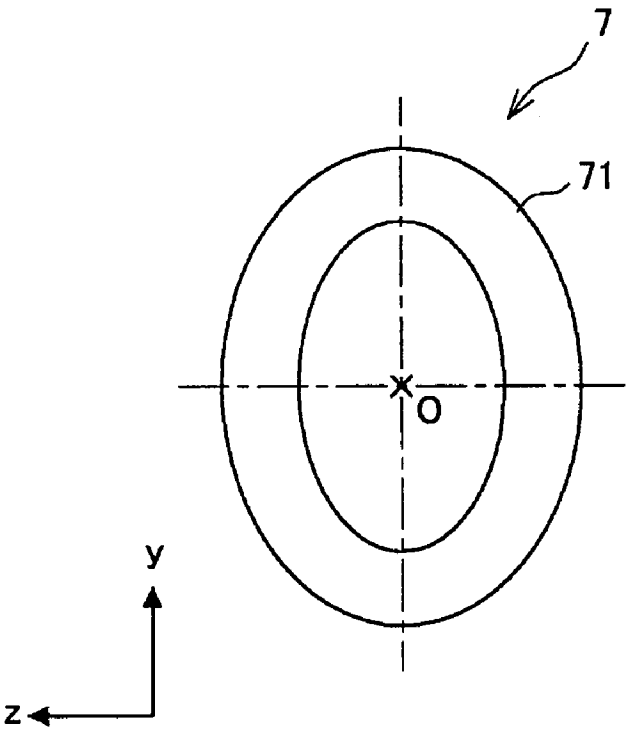
FIG. 3A is an explanatory illustration showing the structure of an earpad according to a first embodiment of the present invention.
Figure 3B:
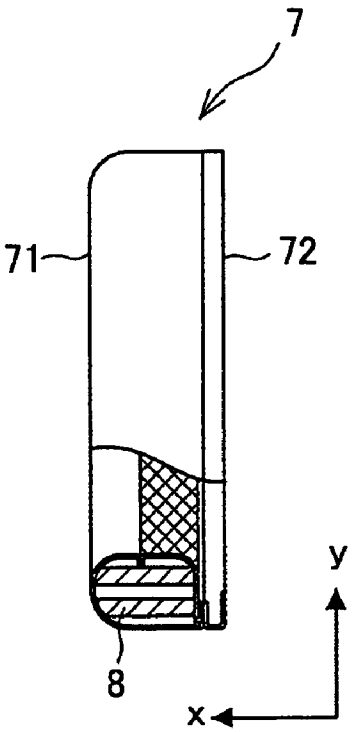
FIG. 3B is an explanatory illustration showing the structure of an earpad according to the first embodiment of the present invention.
Figure 3C:
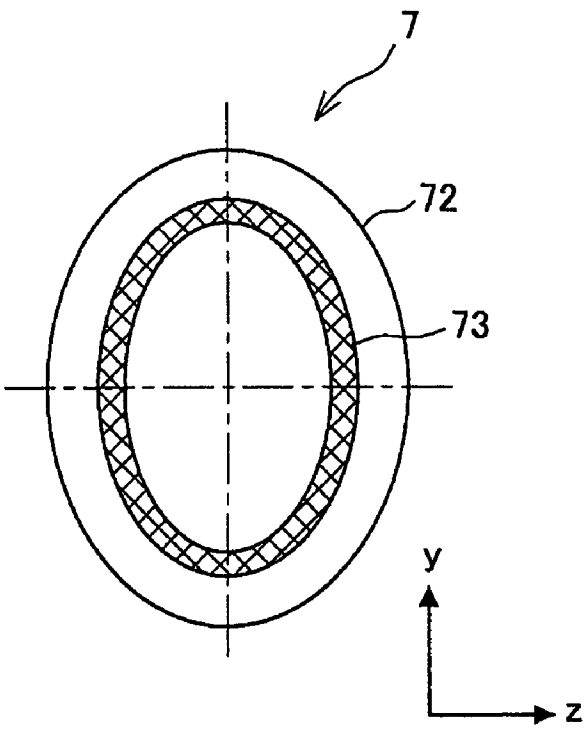
FIG. 3C is an explanatory illustration showing the structure of an earpad according to the first embodiment of the present invention.

FIG. 3 is an explanatory illustration showing the structure of an earpad according to a first embodiment of the present invention. FIG. 3 shows the earpad 7 on the left side. FIG. 3A shows the earpad 7 when viewed from the user's ear side, which is from the earpad 7 on the right side, to the negative direction of the x-axis. FIG. 3B shows the earpad 7 when viewed from the front (the negative direction of the z-axis; the front side of a user) to the backside. FIG. 3C shows the earpad 7 when viewed from the outside, which is from the housing 5 side, to the direction of the earpad 7 on the right side. FIG. 3B partly shows the cross section of the earpad 7.

As shown in FIG. 3, the earpad 7 is ring-shaped, and it includes a cover 71 and a cushion member 8 as broadly divided, having elasticity.

The cushion member 8, which is an example of a ring-shaped cushioning member, has a ring shape made of an elastic material such as urethane foam, cotton and chemical fiber, for example. The material of the cushion member 8 is not limited to those examples, and any material may be used as long as it has appropriate elasticity. The cushion member 8 has a particular structure in order to improve the enclosure tightness of the headphones 1. The structure of the cushion member 8 is described in detail later.

The cover 71 is an example of a covering member, and it is preferably made of a material that is pleasant to touch, such as leather and man-made fiber. The cover 71 covers the cushion member 8. The cover 71 has a connection portion 72 to the housing 5 and a flow-through portion 73 as shown in FIGS. 3B and 3C.

The connection portion 72 is connected to the outer periphery of the earpad 7 on the housing 5 side as shown in FIG. 3B, and it has a substantially U-shape that is open toward the center of the ring. Specifically, the connection portion 72 is formed to extend to the housing and further extend toward the center of the ring at its end. The part that extends toward the center of the ring is inserted into a groove (not shown) on the outer periphery of the housing, so that the earpad 7 is fixed to the housing 5.

Figure 4:
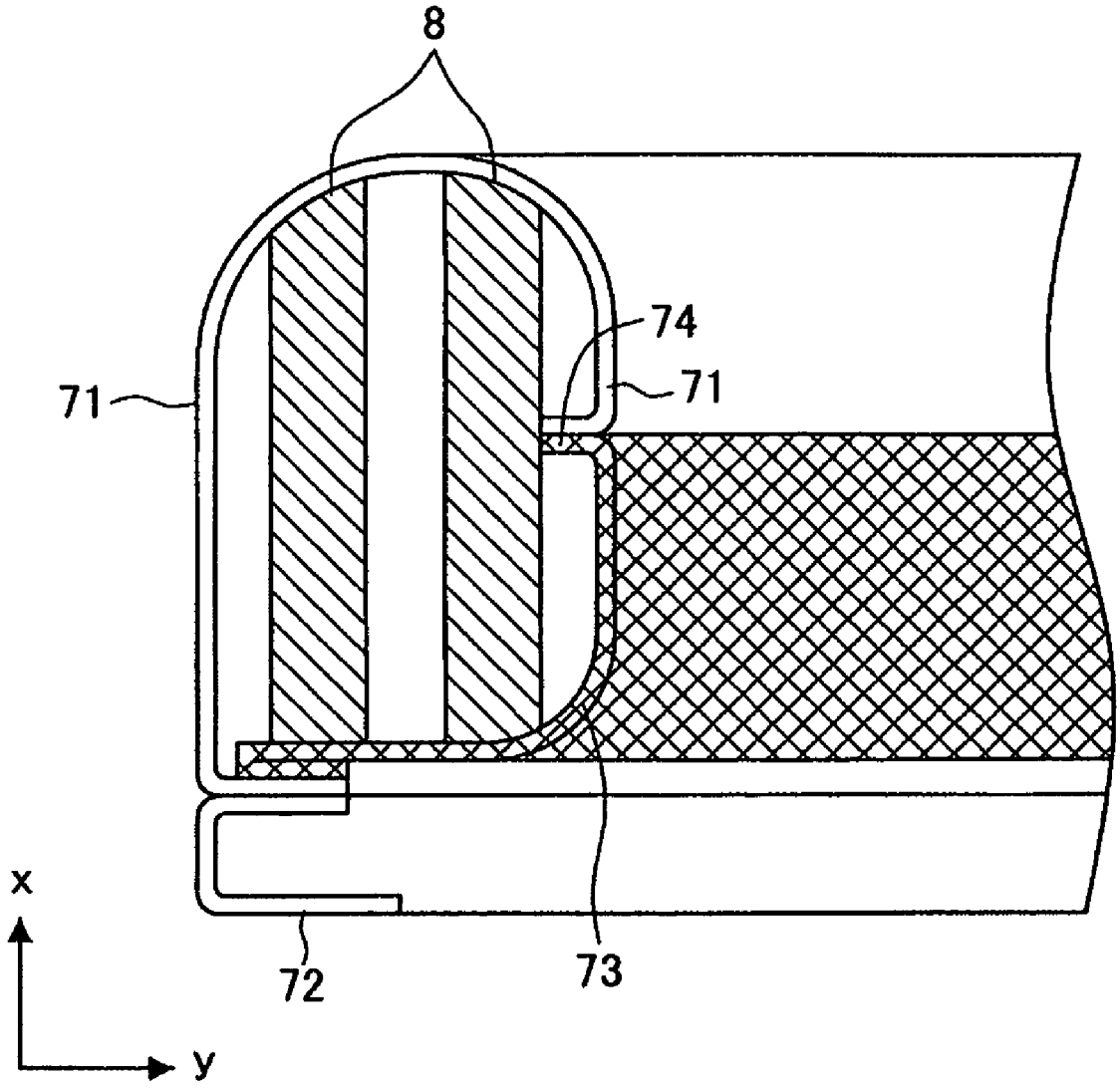
FIG. 4 is an explanatory illustration showing the internal structure of an earpad according to the embodiment.

FIG. 4 shows the internal structure of the earpad 7.

The flow-through portion 73 is made of a material that allows penetration of air such as mesh, for example, and it is sewed together with the cover 71 or the like at an overhang portion 74 or the like as shown in detail in FIG. 4. The flow-through portion 73 allows outflow or inflow of air of the cushion member 8 when the cushion member 8 is compressed or expanded. Specifically, if the cushion member 8, which is elastic and serves as cushioning, is expanded or compressed in the state where it is completely enclosed by the cover 71, the inside air is trapped inside the cover 71 and inhibits the cushioning action of the cushion member 8. To avoid this, the flow-through portion 73 ensures proper air flow through the cover 71, thereby bringing out the cushioning action of the cushion member 8. The flow-through portion 73 preferably lets air flow through the internal space of the cover 71 and the space enclosed by the earpad 7. The flow-through portion 73 may be created by making a hole in the cover 71. A diameter direction of a duct of the cushion member 8 refers to the outward direction from the center O of the ring on the y-z plane in FIG. 3A.

(Cushion Member)

Figure 5A:
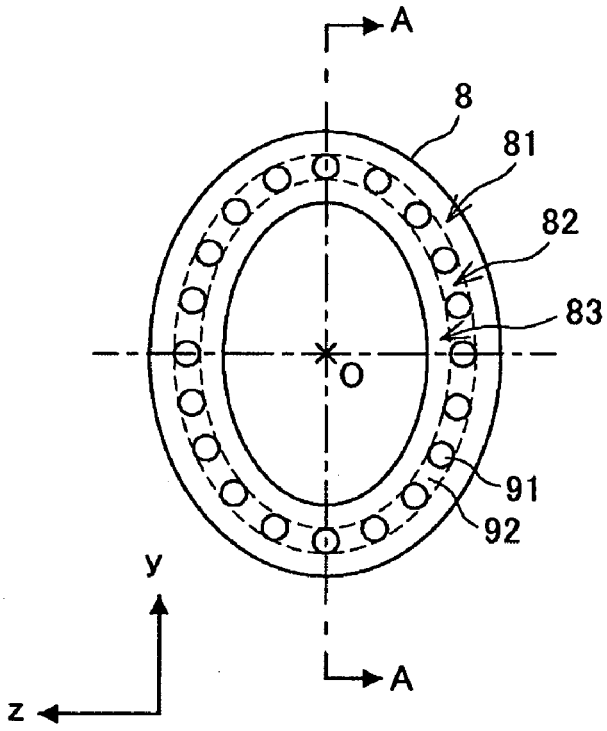
FIG. 5A is an explanatory illustration showing a cushion member according to the embodiment.
Figure 5B:
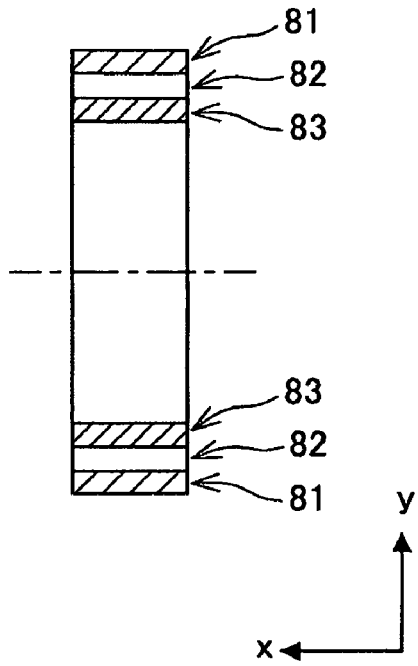
FIG. 5B is an explanatory illustration showing a cushion member according to the embodiment.

The structure of the cushion member 8 of the earpad 7 according to this embodiment is described hereinafter in detail with reference to FIG. 5. FIG. 5 is an explanatory illustration showing the cushion member according to the embodiment. FIG. 5 shows the cushion member 8 of the earpad 7 on the left side. FIG. 5A shows the cushion member 8 when viewed from the user's ear side, which is from the earpad 7 on the right side, to the negative direction of the x-axis. FIG. 5B shows the cross section of the cushion member 8 across the line A-A.

Referring to FIG. 5, the cushion member 8 includes an outer ring member 81, a middle ring member 82 and an inner ring member 83 as broadly divided. In this embodiment, the outer ring member 81, the middle ring member 82 and the inner ring member 83 are integrally formed using the same material.

The outer ring member 81 is placed on the outer periphery of the ring-shaped cushion member 8, and the inner ring member 83 is placed on the inner periphery of the ring-shaped cushion member 8. The middle ring member 82 is placed between the outer ring member 81 and the inner ring member 83. The cross sections of the outer ring member 81, the middle ring member 82 and the inner ring member 83 are substantially rectangular as shown in FIG. 5B.

The middle ring member 82 has a plurality of through-holes 91 that are made in the right-and-left direction of a user, which is the direction from the housing 5 toward the contact surface with a user (the x-axis direction). The holes 91 are made at predetermined intervals along the circumference of the ring as shown in the cushion member 8 of FIG. 5. The cushion member 8 between the hole 91 and the adjacent hole 91 in the middle ring member 82 is referred to as a bridge member 92. The bridge member 92 joins (bridges) the outer ring member 81 and the inner ring member 83 to maintain their positional relationship.

Because of the holes 91, the hardness of the middle ring member is lower than that of the outer ring member 81 and the inner ring member 83. Specifically, in the state where the holes 91 are not made in the middle ring member 82, the middle ring member 82 joins the outer ring member 81 and the inner ring member 83 at the same hardness as the outer ring member 81 and the inner ring member 83 because the middle ring member 82 is made of the same material as the outer ring member 81 and the inner ring member 83. On the other hand, in the state where the holes 91 are made in the middle ring member 82, the part that joins the outer ring member 81 and the inner ring member 83 is limited to the bridge member 92, so that the hardness of the middle ring member 82 that joins the outer ring member 81 and the inner ring member 83 is lower. In other words, the elasticity and the compressibility of the middle ring member 82 are higher than those of the outer ring member 81 and the inner ring member 83.

Figure 6A:
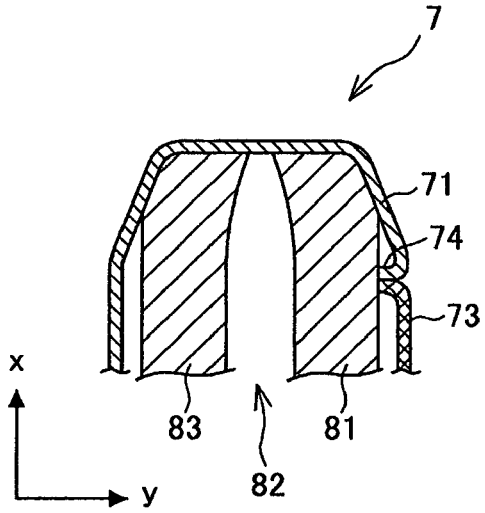
FIG. 6A is an explanatory illustration showing an earpad according to the embodiment.
Figure 6B:
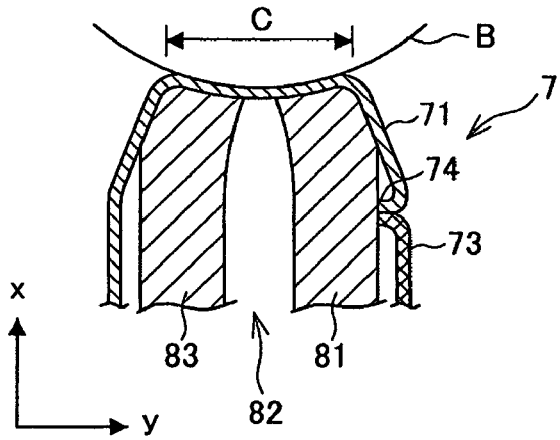
FIG. 6B is an explanatory illustration showing an earpad according to the embodiment.

The state where the cushion member 8 having the above-described structure is placed inside the cover 71 is shown in FIG. 6. FIG. 6 is an explanatory illustration showing the earpad according to the embodiment. FIG. 6A shows the state where the cushion member 8 is placed inside the cover 71, and FIG. 6B shows the state where a user wears the headphones 1 and the earpad 7 is in contact with the user's head. The user's head is in contact with the positive direction of the x-axis.

The cushion member 8 that is placed inside the cover 71 is puckered at its top end (the positive direction of the x-axis) due to the tensile force of the cover 71 as shown in FIG. 6A. Specifically, the outer ring member 81 and the inner ring member 83 bend toward the middle ring member 82 because of the low hardness (rigidity) of the middle ring member 82. However, the tensile force of the cover 71 is absorbed by the bending of the outer ring member 81 and the inner ring member 83, so that the top surfaces (the surfaces to come into contact with a user) of the outer ring member 81 and the inner ring member 83 become substantially flat. Accordingly, when the user's head B comes into contact with the earpad 7, the top surfaces of the outer ring member 81 and the inner ring member 83 are curved as shown in FIG. 6B, yielding to the shape of the head B. Therefore, the earpad 7 comes into contact with the user's head B on a contact surface C.

Figure 7C:
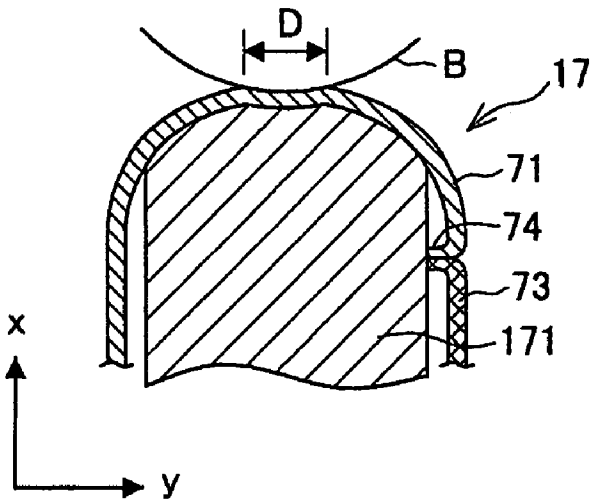
FIG. 7C is a cross-sectional view showing a cross section of an earpad according to the related art of the embodiment.
Figure 7B:
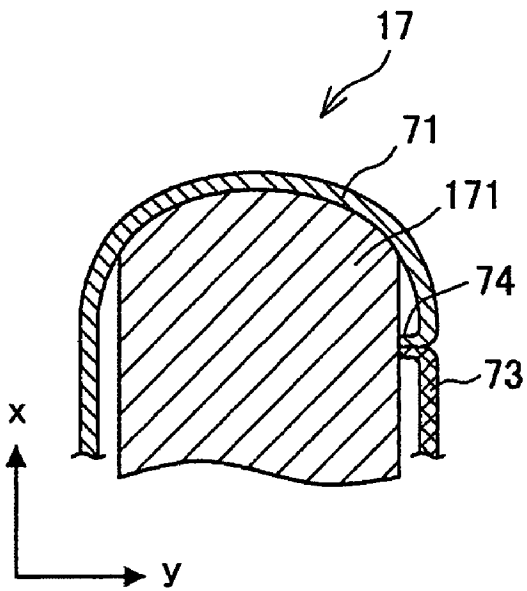
FIG. 7B is a cross-sectional view showing a cross section of an earpad according to the related art of the embodiment.
Figure 7A:
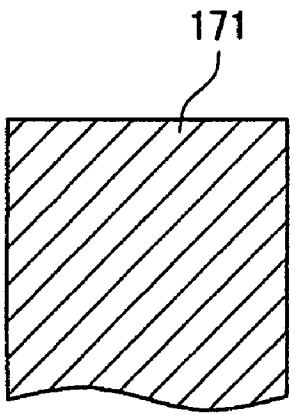
FIG. 7A is a cross-sectional view showing a cross section of an earpad according to a related art of the embodiment.

FIG. 7 shows an earpad 17 related to this embodiment. FIG. 7 is a cross-sectional view showing a cross section of an earpad according to a related art of the embodiment. FIG. 7A shows a cushion member 171 of the earpad 17 according to the related art. FIG. 7B shows the earpad 17 in which the cushion member 171 is placed inside the cover 71. FIG. 7C shows the state where a user wears headphones and the earpad 17 is in contact with the user's head.

The cushion member 171 of the earpad 17 according to the related art is made of the same material as the cushion member 8 described above and has a substantially rectangular cross section. When the cushion member 171 is placed inside the cover 71, the top surface (the surface to come into contact with a user) of the cushion member 171 is deformed into a substantially arc shape due to the tensile force of the cover 71 as shown in FIG. 7B. If a user wears the headphones and the substantially arc-shaped earpad 17 comes into contact with the user's head, a part of the earpad 17 on the upside (in the user direction) is deformed, yielding to the shape of the user's head B as shown in FIG. 7C. However, the yielded deformed part is limited to the top end of the arc shape of the earpad 17, and the earpad 17 comes into contact with the user's head B on a contact surface D.

As apparent from the comparison of the earpad 7 according to this embodiment shown in FIG. 6B and the earpad 17 according to the related art shown in FIG. 7C, the area of the contact surface C of the earpad 7 according to this embodiment is larger than the area of the contact surface D of the earpad 17 according to the related art. Therefore, the earpad 7 according to this embodiment can ensure a large contact area by being deformed yielding to the shape of the user's head, thereby enhancing the enclosure tightness of the headphones 1.

Further, the earpad 7 of this embodiment can flexibly yield to the shape of the user's head because the hardness of the middle ring member 82 is low. Accordingly, if the earpad 7 is used for the headphones 1 that entirely cover the ears (e.g. an enclosed type), for example, the earpad 7 can yield to the shape of the head around the user's ear. On the other hand, if the earpad 7 is used for the headphones 1 that come into contact with the ears (e.g. an open type), the earpad 7 can be deformed according to the shape of the user's ear. Further, the earpad 7 of this embodiment maintains a large contact area even after it is deformed yielding to the shape around the ear or the shape of the ear, so that it can keep the enclosed state and improve the sound quality.

Furthermore, in the earpad 7 of this embodiment, the hardness of the middle ring member 82 can be changed simply by making the holes 91 so as to enhance the enclosure tightness. The earpad 7 can be therefore created very easily. In addition, the earpad 7 eliminates the need to prepare lots of materials for adjusting the hardness, which reduces the number of stocks to be prepared in the manufacturing stage to thereby enable manufacturing cost reduction.

Alternative Example of the First Embodiment

Although the hardness of the middle ring member 82 of the cushion member 8 in the earpad 7 of this embodiment is lowered by making the holes 91 in the middle ring member 82, the hardness distribution in the cushion member 8 may be adjusted by adjusting the size or the number of the holes 91. An alternative example with the adjustment of the hardness distribution is described hereinafter with reference to FIGS. 8 and 9.

Figure 8:
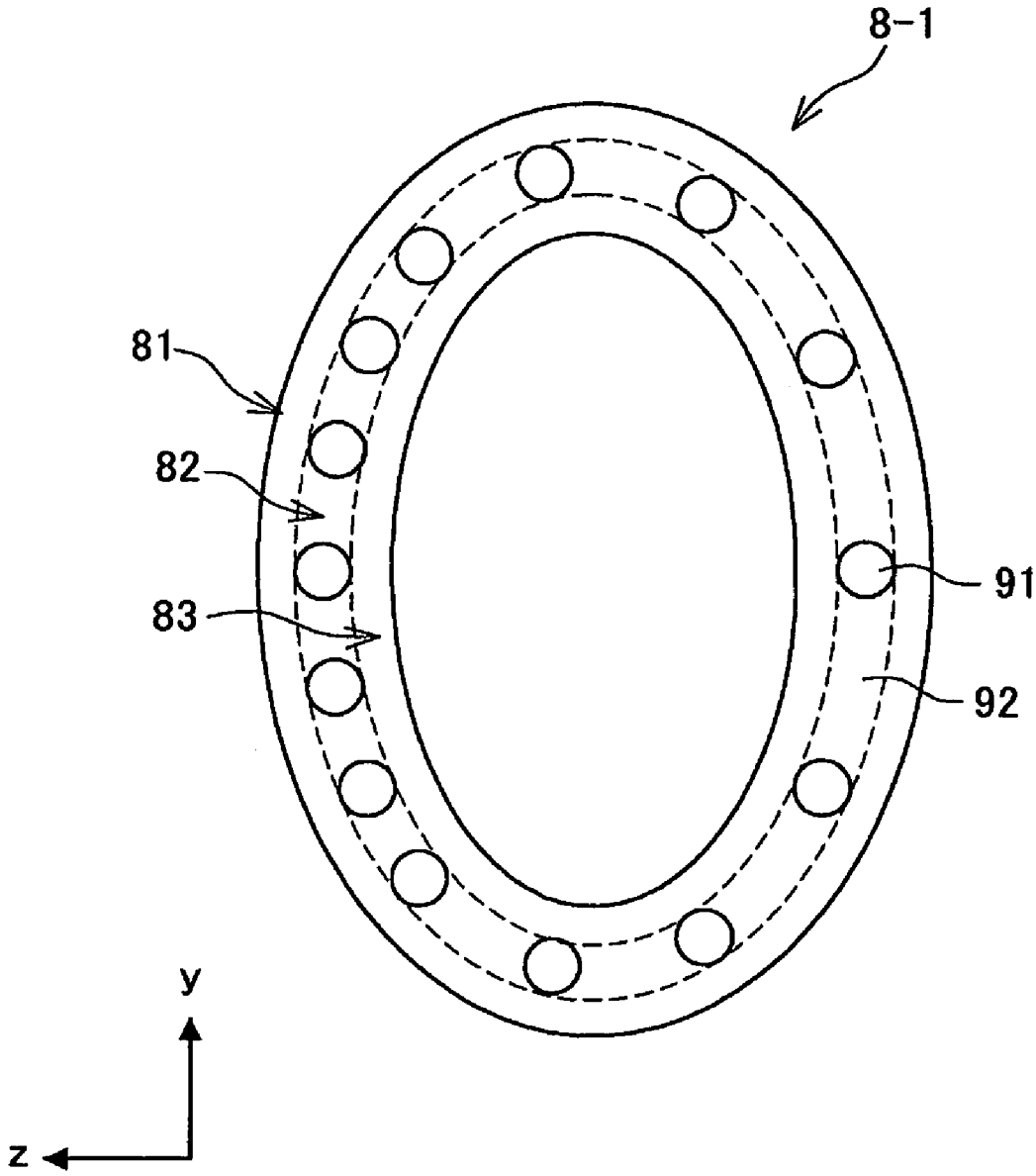
FIG. 8 is an explanatory illustration showing a first alternative example of a cushion member according to the embodiment.

FIG. 8 is an explanatory illustration showing a first alternative example of the cushion member according to the embodiment. FIG. 8 shows a cushion member 8-1 of the earpad on the left side.

Referring to FIG. 8, in the cushion member 8-1 according to the first alternative example, the number of the holes 91 decreases toward the front (in the front direction of a user wearing headphones; the negative direction of the z-axis). Specifically, the number of the holes 91 per unit length of the middle ring member 82 is small in the front part, and the number of the holes 91 becomes larger toward the back along the circumference of the ring. The other elements in this alternative example are identical to those of the cushion member 8 according to the first embodiment and thus not described in detail hereinbelow. In this structure, the hardness of the middle ring member 82 in the rear part, where the density of the holes 91 is higher, is lower than the hardness of the middle ring member 82 in the front part. This allows the rear part of the cushion member 8-1 to be more likely to yield to the shape of the user's head.

The shape of the ear is generally more complex in the rear part than in the front part. Therefore, in the case of the earpad that comes into contact with the user's ear, for example, the enclosure tightness by the earpad can be improved by making the rear part more likely to yield to the ear shape.

On the other hand, in the case of the earpad that covers the part around the user's ear, the earpad comes into contact with the part around the ear. The shape of the head on the rear side of the ear is more inclined with respect to the outer shape of the ear than the shape of the head on the front side of the ear, and therefore a corresponding part needs to be more likely to yield to the inclination. The cushion member 8-1 according to this alternative example can yield to the large inclination on the rear side of the ear, thereby further enhancing the enclosure tightness by the earpad.

A change in the hardness distribution of the middle ring member can be made according to a second alternative example of the embodiment as well. The second alternative example is described hereinafter with reference to FIG. 9.

Figure 9:
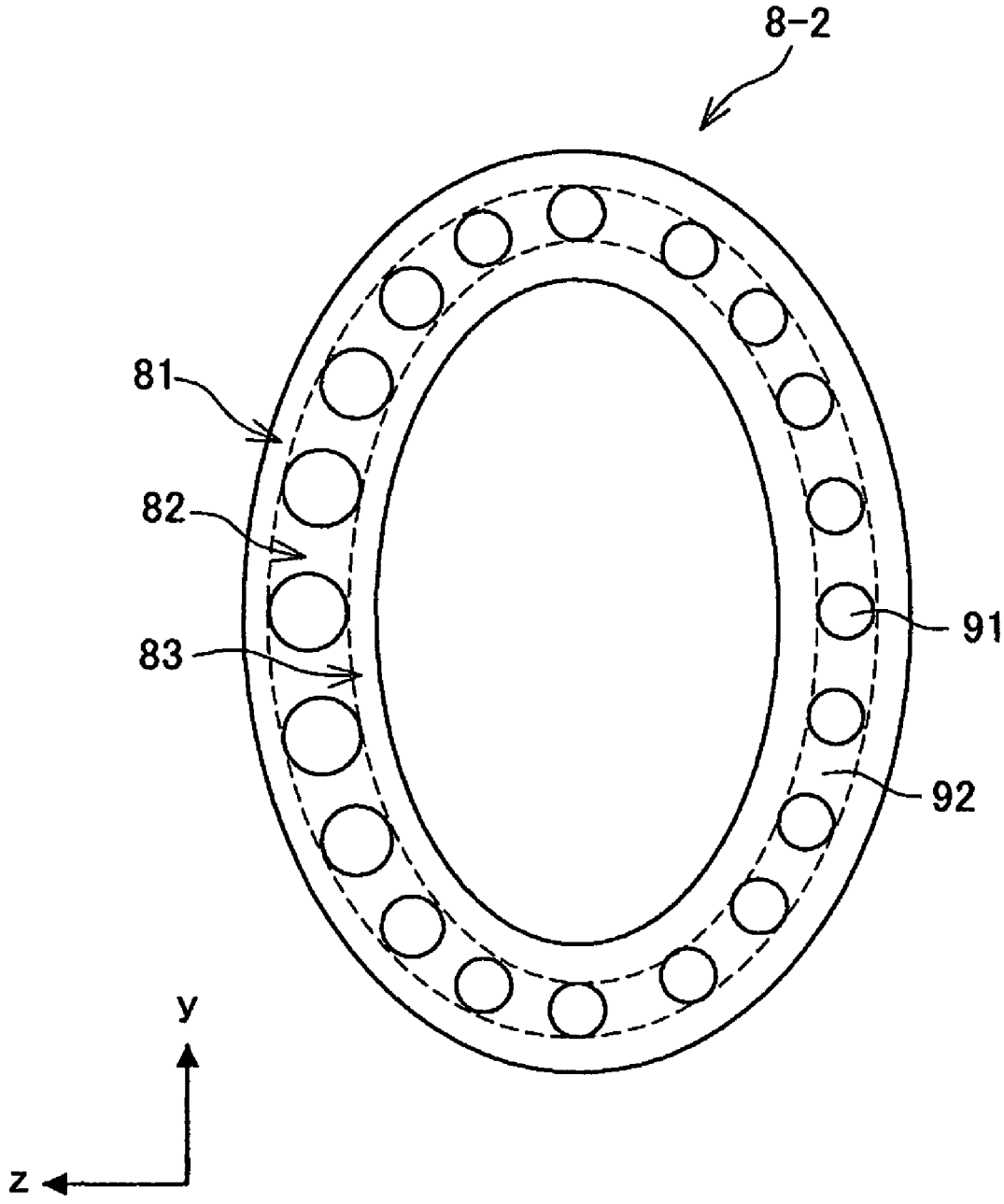
FIG. 9 is an explanatory illustration showing a second alternative example of a cushion member according to the embodiment.

FIG. 9 is an explanatory illustration showing the second alternative example of the cushion member according to the embodiment. FIG. 9 shows a cushion member 8-2 of the earpad on the left side.

Referring to FIG. 9, in the cushion member 8-2 according to the second alternative example, the size of the holes 91 increases toward the back (in the backward direction of a user wearing headphones; the positive direction of the z-axis). Specifically, the size of the holes 91 of the middle ring member 82 is the same as the holes 91 in the first embodiment in the front part, the size of the holes 91 becomes larger toward the back along the circumference of the ring. The other elements in this alternative example are identical to those of the cushion member 8 according to the first embodiment and thus not described in detail hereinbelow.

In the cushion member 8-2 according to the second alternative example, just like the cushion member 8-1 according to the first alternative example described above, the hardness of the middle ring member 82 in the rear part is lower than the hardness of the middle ring member 82 in the front part. This allows the rear part of the cushion member 8-2 to be more likely to yield to the shape of the user's head. Therefore, the second alternative example has the same function and advantage as the first alternative example.

As apparent from the first alternative example and the second alternative example, the earpad according to the embodiment allows the hardness of the middle ring member 82 to be changed easily by changing the size and the number of the holes 91 that are made in the middle ring member 82. Therefore, besides the above-described alternative examples, it is possible to achieve a desired hardness by changing the size and the number of the holes 91. The first alternative example and the second alternative example have the same function and advantage as the first embodiment.

Second Embodiment

Figure 10A:
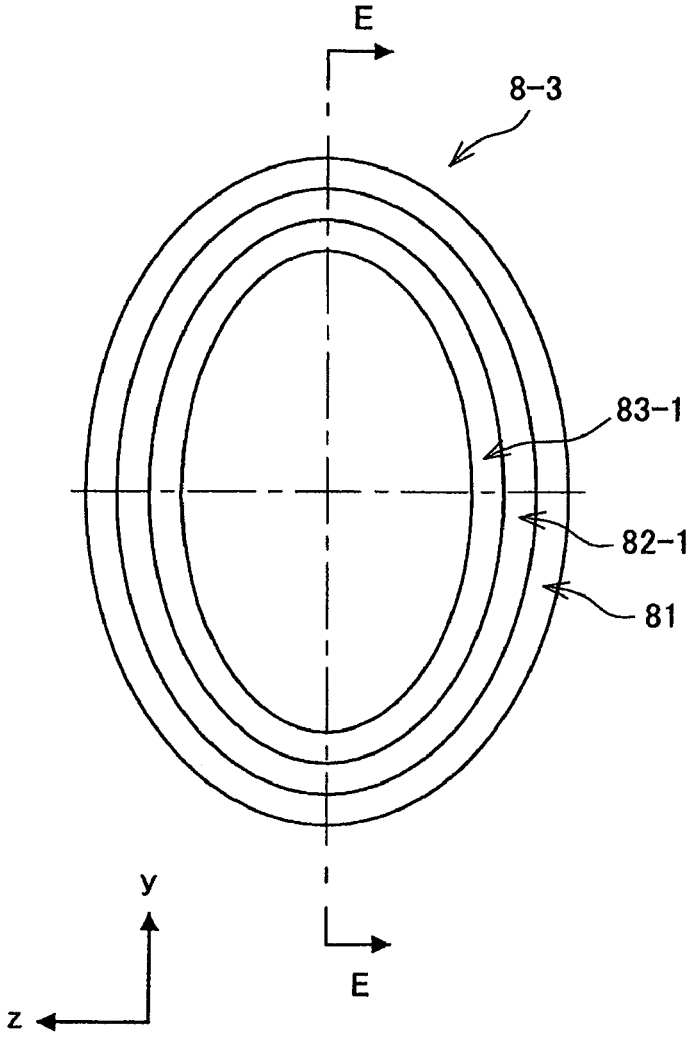
FIG. 10A is an explanatory illustration showing a cushion member according to a second embodiment of the present invention.
Figure 10B:
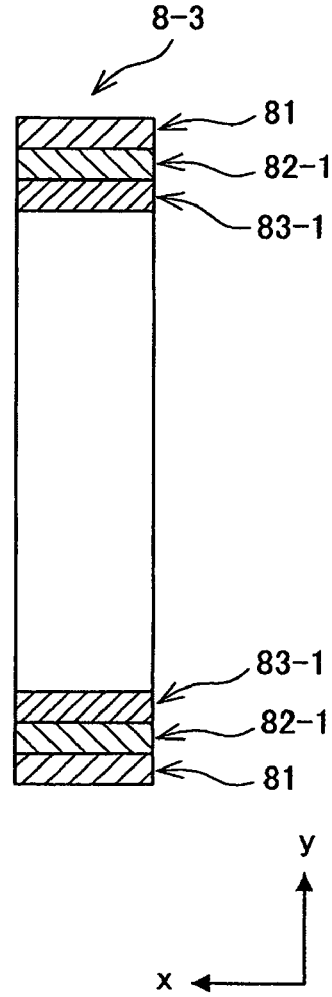
FIG. 10B is an explanatory illustration showing a cushion member according to the second embodiment of the present invention.

A cushion member included in an earpad according to a second embodiment of the present invention is described hereinafter with reference to FIG. 10. FIG. 10 is an explanatory illustration showing the cushion member according to the second embodiment of the present invention. FIG. 10 shows a cushion member 8-3 of the earpad on the left side. FIG. 10A shows the cushion member 8-3 when viewed from the user's ear side, which is from the earpad on the right side, to the negative direction of the x-axis. FIG. 10B shows the cross section of the cushion member 8-3 across the line E-E.

In the first embodiment described earlier, the hardness of the middle ring member 82 is relatively lowered by making the holes 91 in the middle ring member 82. On the other hand, in the cushion member 8-3 according to this embodiment, the hardness of the middle ring member is relatively lowered by changing the material of the middle ring member 82-1. This is described in detail below.

The cushion member 8-3 of this embodiment has a three-layer structure, which is the same as the cushion member 8 of the first embodiment. Specifically, the cushion member 8-3 includes the outer ring member 81, the middle ring member 82-1 and the inner ring member 83-1. The outer ring member 81 is made of the same material as the outer ring member 81 of the cushion member 8 according to the first embodiment.

On the other hand, the middle ring member 82-1 is made of a material having a lower hardness than the outer ring member 81. The inner ring member 83-1 is also made of a material having a lower hardness than the outer ring member 81. The hardness of the middle ring member 82-1 is lower than the hardness of the inner ring member 83-1. Accordingly, the hardness of the ring members is in the following order from the highest:

the outer ring member 81> the inner ring member 83-1> the middle ring member 82-1.

In this structure, the outer ring member 81 and the inner ring member 83-1 bend toward the middle ring member 82-1 due to the tensile force of the cover, just like in the first embodiment, thereby enlarging the contact area. Therefore, the earpad that includes the cushion member 8-3 of this embodiment has the same function and advantage as described in the first embodiment.

Although the inner ring member 83-1 is made of a material having a lower hardness than the outer ring member 81, the outer ring member 81 and the inner ring member 83-1 may be made of the same material to have the same hardness, which also ensures the enclosure tightness just like the first embodiment.

However, according to the embodiment, the outer ring member 81 can be more closely in contact with the user's head by setting the hardness of the outer ring member 81 to be higher than the hardness of the inner ring member 83-1. Therefore, the earpad that includes such a cushion member 8-3 can further enhance the enclosure tightness. Because the hardness of the inner ring member 83-1 is lower than the hardness of the outer ring member 81, the deformation of the inner ring member 83-1 toward the middle ring member 82-1 is larger than that of the outer ring member 81. This secures the flatness of the surface of the outer ring member 81 that comes into contact with the user's head. Generally, the user's head projects most largely toward the headphones at the ear position, and the user's head becomes farther from the headphone with distance from the ear position. In the above-described structure, the outer ring member 81 can be more closely in contact with the head yielding to such an outer shape of the head. The earpad can thereby further improve the enclosure tightness.

It should be understood by those skilled in the art that various modifications, combinations, sub-combinations and alterations may occur depending on design requirements and other factors insofar as they are within the scope of the appended claims or the equivalents thereof.

Figure 11:
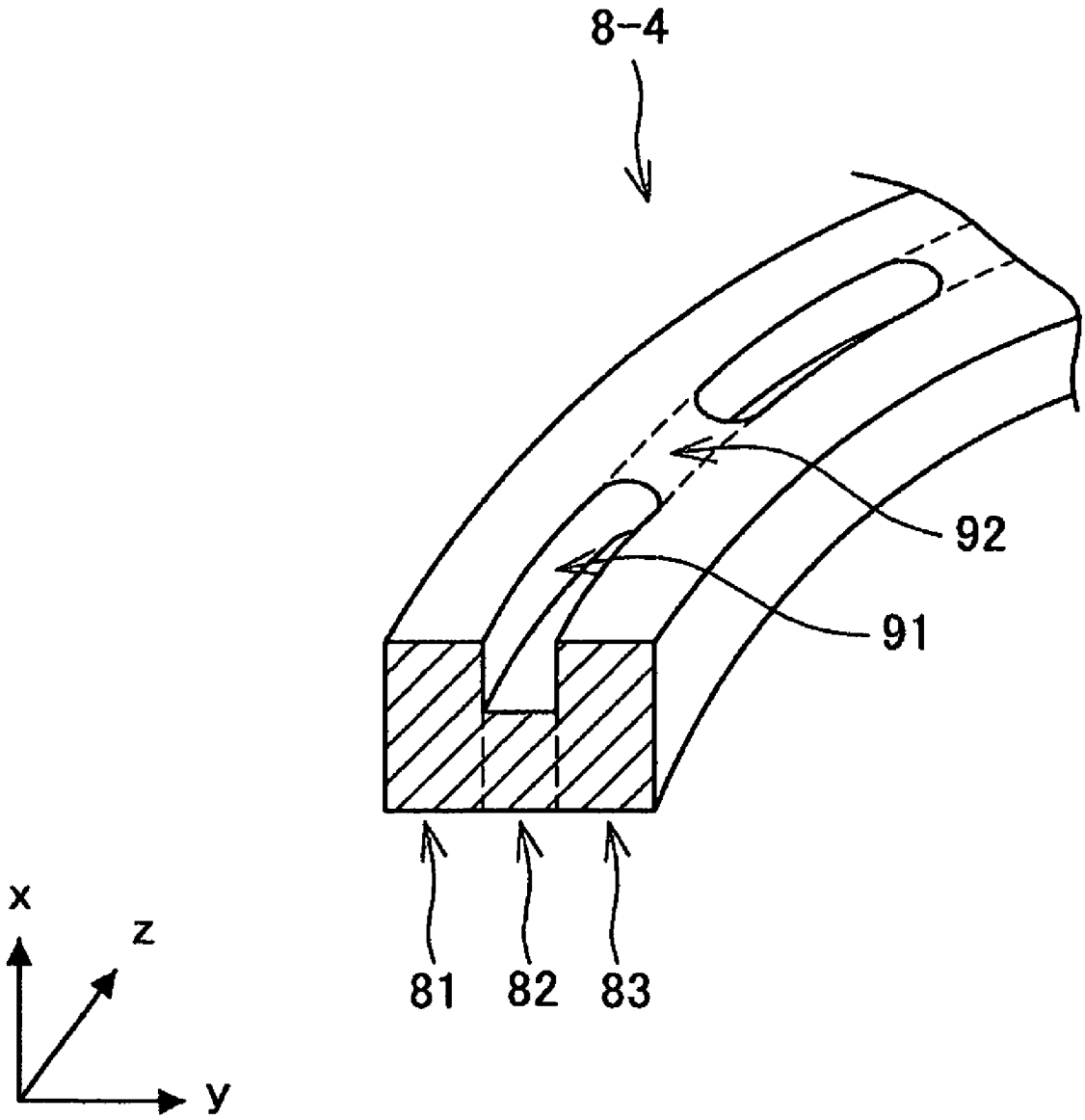
FIG. 11 is an explanatory illustration showing a cushion member according to another embodiment of the present invention.

For example, although the holes 91 are through-holes in the first embodiment, the present invention is not limited thereto. The holes 91 may not be through-holes as shown in FIG. 11, for example. In such a case, the holes 91 are made in the surface that comes into contact with the user's head, and the bridge member 92 is placed at the bottom of the holes 91 (the negative direction of the x-axis).

Further, although the holes 91 are substantially columnar as shown in FIG. 8 or the like in the first embodiment, the present invention is not limited thereto. For example, the holes 91 may have an oval cross section, or a substantially rectangular cross section, though not shown. Although the holes 91 shown in FIG. 11 are not through-holes, the holes 91 may be long through-holes.

Furthermore, although the hardness distribution in the cushion member is adjusted by changing the material of the middle ring member and so on in the second embodiment, the present invention is not limited thereto. For example, the holes 91 may be made in addition to changing the material of the middle ring member 82-1 and so on. The shape of the holes 91 may be altered in various ways as described above.

Figure 12:
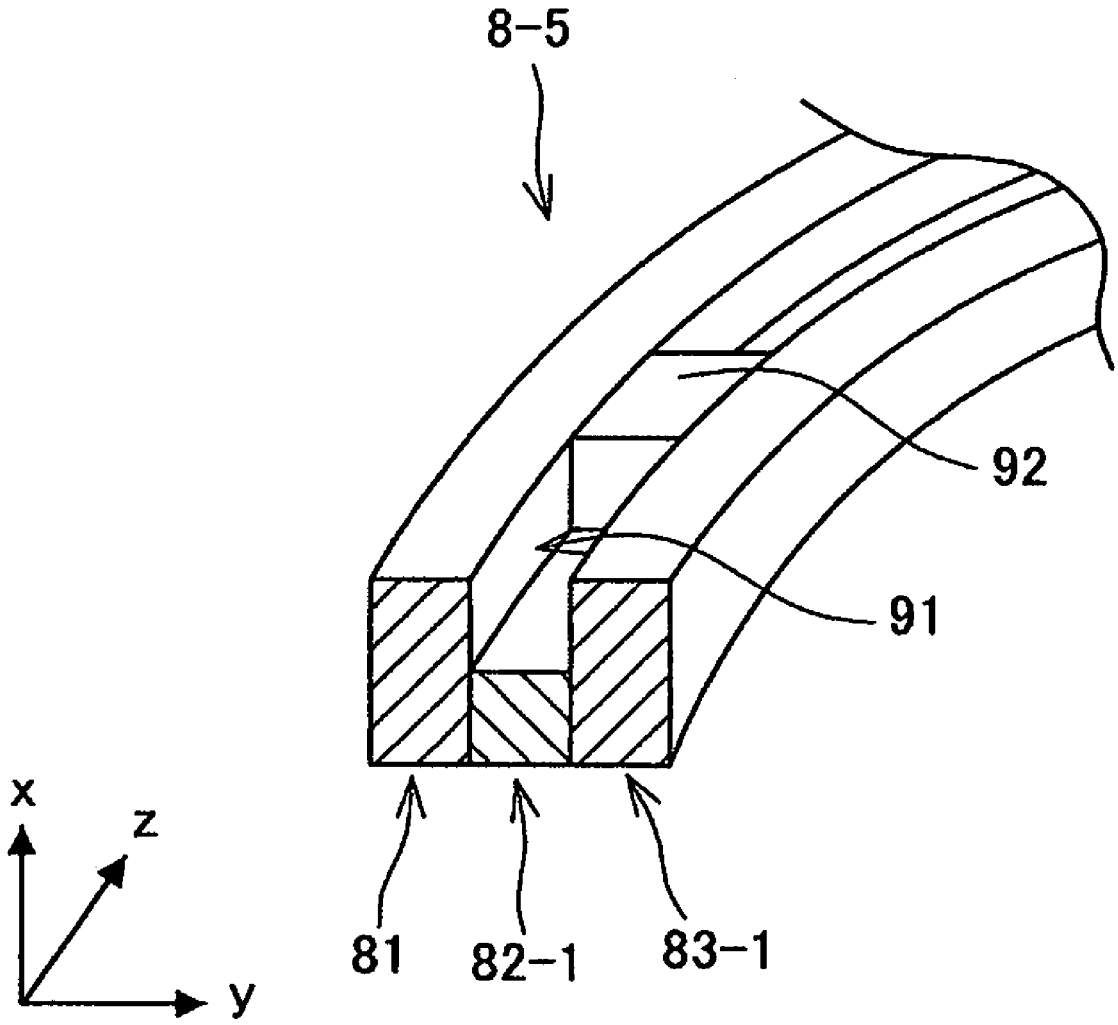
FIG. 12 is an explanatory illustration showing a cushion member according to another embodiment of the present invention.

FIGS. 11 and 12 show cushion members 8-4 and 8-5 that are included in the earpad for the left ear, and they show cross sections as well. In the uncut state, the cushion members 8-4 and 8-5 are configured in the same manner as described in the first embodiment or the second embodiment except for the shape or the like of the holes 91.

Although the case where the earpads are used for headphones is described in the above embodiments, the present invention is not limited thereto. The earpads according to the above embodiments may be applied to any device in which the earpads come into contact with the user's ears or the head around the ears so as to enclose the internal space, such as headsets, ear mufflers and helmets.

What is claimed is:

1. An earpad comprising:

a ring-shaped cushioning member; and a covering member covering the ring-shaped cushioning member, wherein the ring-shaped cushioning member includes an outer ring member, a middle ring member and an inner ring member, the hardness of the middle ring member is different from the hardness of the outer ring member and the inner ring member, the hardness of the middle ring member being dependent on a size or number of a plurality of holes placed in the middle ring member, and the earpad is attachable to a housing capable of containing an audio signal processing unit.

2. The earpad according to claim 1, wherein the hardness of the middle ring member is lower than the hardness of the outer ring member.

3. The earpad according to claim 2, wherein the hardness of the middle ring member is lower than the hardness of the inner ring member.

4. The earpad according to claim 2, wherein the hardness of the inner ring member is lower than the hardness of the outer ring member.

5. The earpad according to claim 2, wherein the middle ring member is configured as a bridge member joining the outer ring member and the inner ring member.

6. The earpad according to claim 2, wherein the hardness of the middle ring member is lower in a rear part than in a front part.

7. Headphones comprising:

a housing capable of containing an audio signal processing unit; and an earpad attached to the housing and including a ring-shaped cushioning member and a covering member covering the ring-shaped cushioning member, wherein the ring-shaped cushioning member includes an outer ring member, a middle ring member and an inner ring member, the hardness of the middle ring member is different from the hardness of the outer ring member and the inner ring member, and the hardness of the middle ring member is dependent on a size or number of a plurality of holes placed in the middle ring member.

* * * * *